US006513791B1

(12) United States Patent
Yates

(10) Patent No.: US 6,513,791 B1
(45) Date of Patent: Feb. 4, 2003

(54) FISH TAPE WITH AUTOMATIC REELING FEATURE

(75) Inventor: Mark Steven Yates, Cornelius, NC (US)

(73) Assignee: Backspin, Inc., Charlotte, NC (US)

( * ) Notice: Subject to any disclaimer, the term of this patent is extended or adjusted under 35 U.S.C. 154(b) by 35 days.

(21) Appl. No.: 09/606,850

(22) Filed: Jun. 29, 2000

(51) Int. Cl.[7] ..... B65H 75/30

(52) U.S. Cl. ..... 254/134.3 ft; 242/390.8; 242/395

(58) Field of Search ..... 242/390.8, 390.9, 242/395, 405.3, 394.1; 254/134.3 FT

(56) References Cited

U.S. PATENT DOCUMENTS

| | | | | | |
|---|---|---|---|---|---|
| 2,755,066 | A | * | 7/1956 | Mallasch | 254/134.3 FT |
| 3,145,972 | A | | 8/1964 | Sweeney | |
| 3,355,123 | A | * | 11/1967 | Schinske | 242/396.5 |
| 3,528,644 | A | * | 9/1970 | Scott | 254/134.3 R |
| 3,533,599 | A | * | 10/1970 | Hindenburg | 254/143.3 FT |
| 3,549,127 | A | * | 12/1970 | Niemann | 254/134.3 FT |
| 3,568,947 | A | * | 3/1971 | Oprins | 242/405.2 |
| 3,582,044 | A | * | 6/1971 | Gardner | 254/134.3 FT |
| 3,809,366 | A | * | 5/1974 | Crees | 254/134.3 FT |
| 3,837,624 | A | | 9/1974 | Dandurand | |
| 4,033,703 | A | * | 7/1977 | Slater | 408/211 |
| 4,092,780 | A | * | 6/1978 | Trethewey et al. | 33/762 |
| 4,251,038 | A | * | 2/1981 | Gename | 242/397.2 |
| 4,413,808 | A | | 11/1983 | Finkle | |
| 4,917,362 | A | | 4/1990 | Wilson | |
| 4,971,293 | A | | 11/1990 | Roberson, Jr. | |
| 5,149,056 | A | * | 9/1992 | Jones | 254/134.3 FT |
| 5,421,533 | A | * | 6/1995 | Scott et al. | 242/405.3 |
| 5,423,516 | A | * | 6/1995 | Blaha | 254/143.3 FT |
| 5,588,613 | A | | 12/1996 | Nagy | |
| 5,609,311 | A | | 3/1997 | Palm | |
| 6,015,111 | A | * | 1/2000 | Berke | 242/394 |
| 6,244,038 | B1 | * | 6/2001 | Brannstrom et al. | 60/39.12 |
| 6,357,133 | B1 | * | 3/2002 | Hsu | 33/755 |
| 6,398,147 | B1 | * | 6/2002 | Fredrickson | 242/390.8 |
| 6,416,040 | B1 | * | 7/2002 | Bergman | 254/134.3 FT |

* cited by examiner

*Primary Examiner*—Donald P. Walsh
*Assistant Examiner*—Daniel K Schlak
(74) *Attorney, Agent, or Firm*—Alston & Bird LLP

(57) ABSTRACT

A center drive device for use with a fish tape apparatus is provided. The center drive device includes a body portion for engaging a central opening defined by the fish tape apparatus and securing the center drive device thereto. The center drive device is frictionally secured to the fish tape apparatus, such as by an interference fit. The center drive device also includes a drive fitting positioned coaxially with the central opening of the fish tape apparatus. The drive fitting is adapted for engagement with a powered driver for reeling in a flexible tape attached to the wire pulling device. A fish tape apparatus is also provided having a reel and an integrally formed center drive device.

23 Claims, 5 Drawing Sheets

FISH TAPE WITH AUTOMATIC REELING FEATURE

FIELD OF THE INVENTION

The present invention relates to the field of wire pullers, and more particularly to fish tape devices used for pulling electrically insulated wires or other materials through a conduit. Further, the present invention relates to attachments to fish tape devices to aid in pulling the wires through a conduit.

BACKGROUND OF THE INVENTION

It has long been known in the residential, commercial, and industrial electrical contracting fields to provide electrical circuits comprising junction boxes, switches, and outlets interconnected by a series of electrically insulated wires routed through lengths of conduit or piping. In many cases, it is necessary to draw the insulated wires through the lengths of conduit over relatively great distances, or behind walls, or past bends in the conduit. Where the insulated wires are not sufficiently rigid such that they cannot be drawn through the conduit by feeding the wires themselves through the conduit, a device known in the art as a "fish tape" may be used for drawing the wires or a string attached to the wires through the conduit.

A fish tape generally comprises a thin yet resilient strip or rod of metal or plastic having a loop or other attachment on one end. The fish tape can be fed into one end of the conduit and is capable of following bends in the conduit without hindrance. After the fish tape has been drawn through the conduit such that the loop end of the fish tape emerges from an opposite end of the conduit, an insulated wire or string is connected to the loop end of the fish tape and drawn back through the conduit. If a string is connected to the loop end of the fish tape, the string is first drawn through the conduit followed by the wire, which is connected to the other end of the string.

Early fish tapes were loose and uncontained, which often resulted in tangled and knotted fish tape strewn about the floor of the workplace. Modern fish tapes devices, however, often incorporate a reel such that the fish tape is wound around the reel by manually rotating the reel about a handle. More specifically, the reel is formed as a flattened ring-shaped rotatable body having a slot formed all the way around its outer circumference. The reel is usually formed in two generally mirror-image halves that fit together so as to create an interior space for storing the fish tape. The reel has an inner hub on which the fish tape is wound. The free end of the fish tape having the loop attachment extends through the outer slot in the reel. The handle is attached to the reel to facilitate grasping the device while the fish tape is extended and reeled in. As stated above, the reel can rotate relative to the handle to pay out or reel in the fish tape. This is accomplished by positioning the handle to engage the outer slot such that the handle can slide along the slot. In both the early and modem cases described above, however, the fish tape is drawn through the conduit by hand, either by pulling the fish tape itself, or by grasping the reel and turning it to wind the fish tape onto the reel.

One problem with current fish tape devices is that it is very difficult to pull lengthy amounts of wire or string through the conduit. In particular, on long runs of conduit such as often found in a commercial building, several electricians or other workers may be required to manually pull the wire or string through the conduit. Such a procedure is often inefficient, fatiguing, and potentially dangerous. To compound the problem, conventional manually-operated fish tape devices require that the fish tape then be wound about the reel, which wastes valuable time and energy of the electrician.

To address the above-mentioned problems, powered fish tape devices have been developed in which the fish tape is stored within the confines of the device and controllably payed out and reeled in by a drive motor so that the fish tape travels through the conduit until it extends from the free end thereof, where a wire is attached to the end of the fish tape and then drawn through the conduit by reeling the fish tape back into the device. Such a device is disclosed in U.S. Pat. No. 4,917,362. Powered fish tape devices, however, typically include a high number of parts and a sophisticated series of gears, both of which involve high complexity and cost. Furthermore, these devices typically employ their own integrated motors, thus having no adaptability or interoperability with existing fish tape devices.

Still other devices have been developed that address the above-mentioned problems by providing an attachment for existing fish tape devices that enable a user to manually reel the fish tape into the fish tape device. For example, U.S. Pat. No. 5,558,613 discloses a fish tape reel attachment having a rigid frame member comprising two parallel bars that extend along the sides of the fish tape reel and a fixed handle at one end of the frame. A ratchet and/or hand crank is attached to an internal hub disposed between the parallel bars and fitted to the fish tape reel for paying out or reeling in the fish tape. However, the attachment also includes a high number of parts and a series of gears, thus involving high complexity. The attachment would also make the fish tape device awkward to use, because the location of the handle requires the user to support the weight of the device that is cantilevered forward from the handle. Furthermore, the attachment described in U.S. Pat. No. 5,558,613 provides a device for manually reeling in the fish tape, thus resulting in a long and tiring process.

Thus, there is a need for a fish tape device which can reel in a fish tape without manually operating the device. More specifically, there is a need for a fish tape device having low complexity and cost that allows a fish tape to be wound automatically to save valuable time and effort on the part of the user.

SUMMARY OF THE INVENTION

These and other needs are provided, according to the present invention, by a fish tape device having a reel center drive device that provides a drive fitting for engaging a driver, such as a powered driver, for automatically reeling in the fish tape about the reel.

In one embodiment, the fish tape reel center drive device of the present invention comprises an attachment for a fish tape reel that is secured in a central opening of the reel using an interference or frictional fit. The body portion of the attachment can be solid and shaped to generally match the shape of the central opening in the reel, but can also take on other forms, such as a hub and spoke configuration, where the spokes extend towards the reel and secure the center drive device as described above. In another embodiment, the center drive device is formed integrally with the reel, such as by injection-molding the reel and the body portion of the center drive device as a one-piece construction. Advantageously, the center drive device includes at least one drive fitting attached to the body portion and positioned coaxially with the central rotation axis of the reel. The drive fitting extends outwardly from the body portion and is positioned for engagement with a powered driver capable of rotating the body portion and, thus, the reel while the handle is held by an operator. Alternatively, drive fittings may be attached to both of the opposite sides of the body portion so that a powered driver can be used on either side of the attachment for automatically reeling in the fish tape.

The fish tape device preferably has a reel that defines a slot extending about its outer circumference and a handle slidably engaged in the slot so that the handle can be grasped in a comfortable position with one hand while the other hand holds a powered driver in engagement with the center drive device to rotate the reel.

The present invention thus seeks to provide a device for easily and efficiently operating a fish tape reel that includes minimal parts. The invention in some embodiments also seeks to provide adaptability and interchangeability with existing fish tape reel devices and powered drivers in the marketplace. As such, the present invention provides a low-cost solution to the problem of automatically reeling in fish tapes.

BRIEF DESCRIPTION OF THE DRAWINGS

Some of the objects and advantages of the present invention having been stated, others will appear as the description proceeds when taken in conjunction with the accompanying drawings which are not necessarily drawn to scale, wherein.

DETAILED DESCRIPTION OF THE INVENTION

Figure 1:
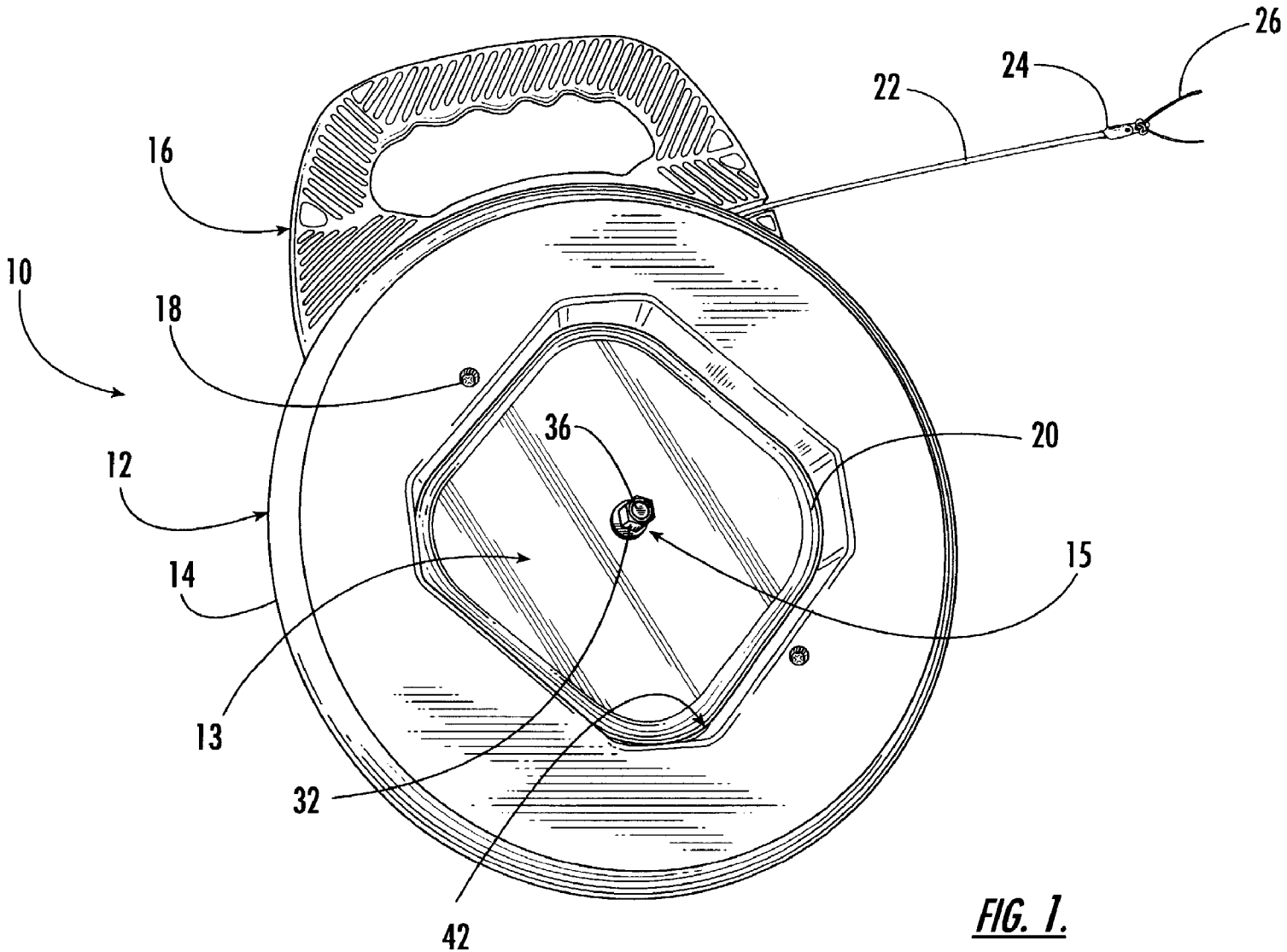
FIG. 1 is a perspective view of a fish tape apparatus according to one embodiment of the present invention.
Figure 2:
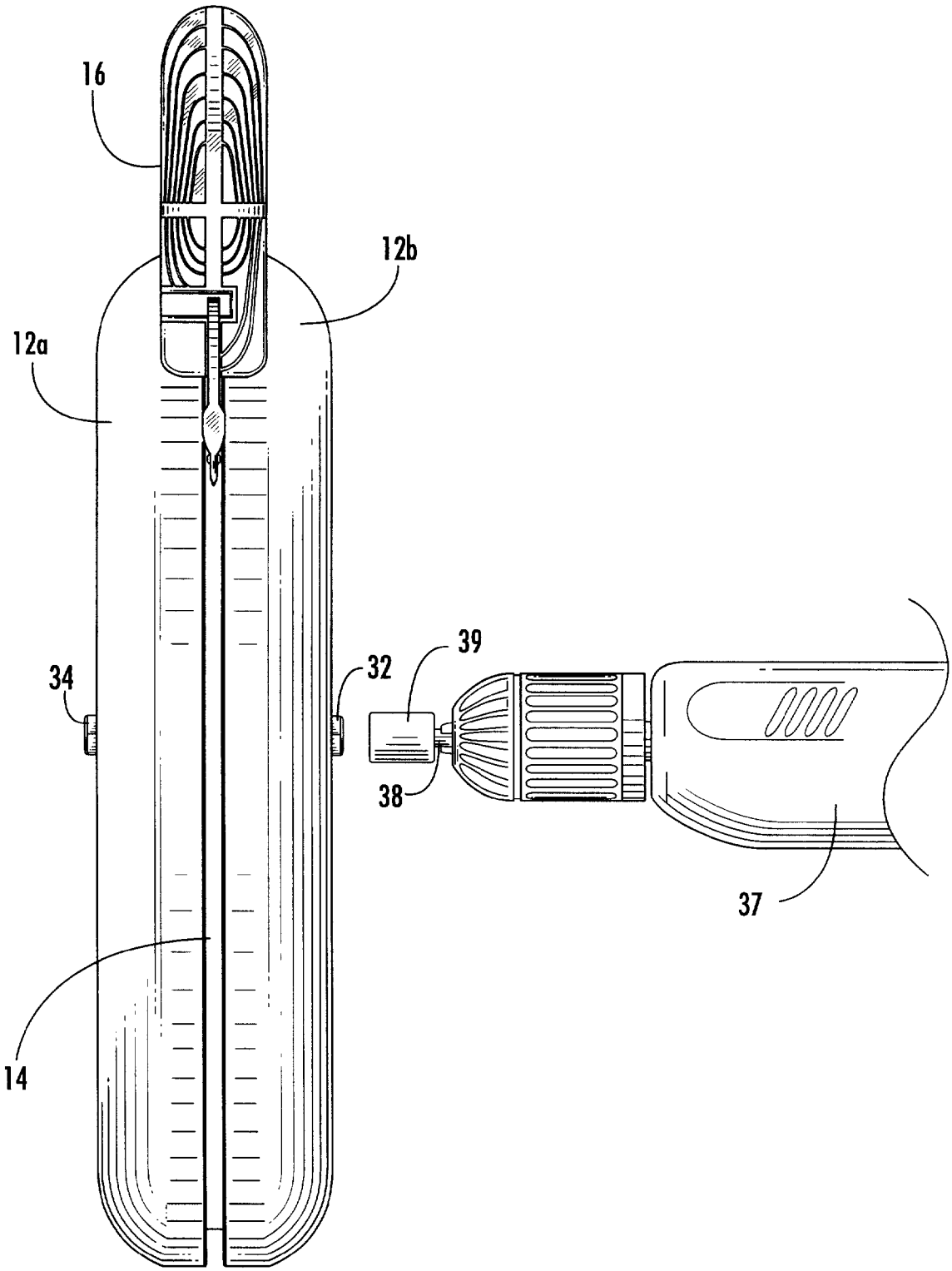
FIG. 2 is an end view of the fish tape apparatus shown in FIG. 1.
Figure 3:
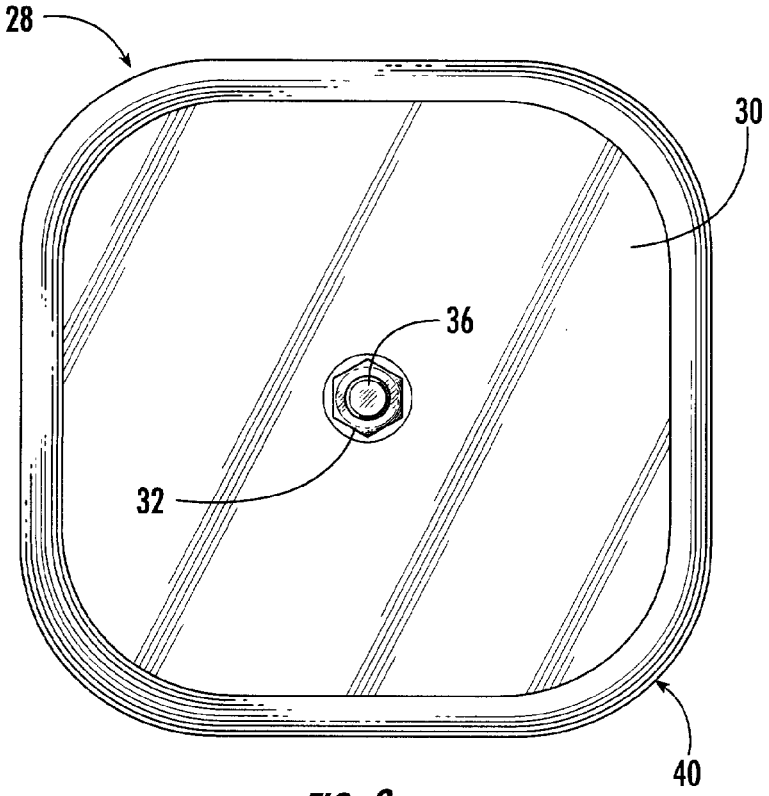
FIG. 3 is an elevation of one embodiment of the fish tape center drive device according to the present invention.
Figure 4:
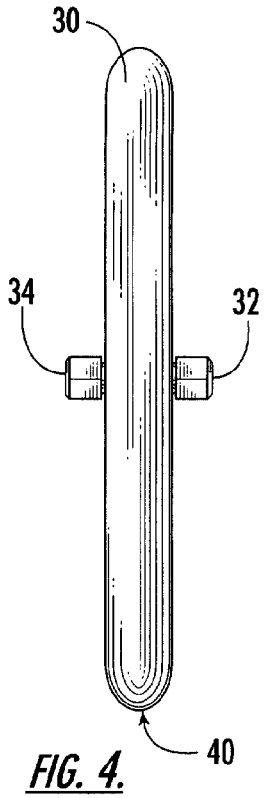
FIG. 4 is a side view of the fish tape center drive device of FIG. 3.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring first to FIGS. 1–5, a fish tape apparatus is represented generally by the numeral 10. The apparatus 10 comprises a housing or reel 12 which is formed from a pair of ring-shaped members 12*a*, 12*b* held together by adhesives or fasteners, such as screws 18. The ring-shaped members 12*a*, 12*b* are positioned to define a slot 14 extending around the reel 12 between the ring-shaped members. A handle 16 is slidably attached to the reel 12 by engagement in the slot 14 such that the reel 12 can be moved relative to the handle 16 and rotated about central axis 15 while holding the handle 16.

In one embodiment, the reel 12 defines a central opening 13 therein and is formed to include a central hub 20 radially inward of the slot 14. The hub 20 supports a fish tape 22 attached to and wound about the hub 20. In one embodiment, the fish tape 22 is about 200 feet long, although other lengths may be used depending on the application. The fish tape 22 comprises a resiliently flexible metal or plastic tape or cord and includes loop attachment wires 26 at a distal end 24. The distal end 24 of the fish tape 22 extends from the reel 12 through the slot 14 and is fed into a conduit for attachment to wires or other bodies, such as string, to be pulled back through the conduit. The fish tape 22 wound about the hub 20 is contained between the ring-shaped members 12*a*, 12*b* and is capable of being payed out and reeled in by rotating the reel 12 about the central axis 15 while maintaining the handle 16 in a stationary position. In particular, the handle 16 is held by an operator such that the reel 12 slides along the slot 14 relative to the handle 16, allowing the tape to be payed out or reeled into the apparatus 10. However, manually rotating the reel 12 relative to the handle 16 when reeling in the tape can be tiresome, laborious, and inefficient.

Advantageously, the present invention includes a center drive device 28 for automatically reeling in the fish tape 22 about the reel 12. In one embodiment, the center drive device 28 is an attachment for an existing fish tape apparatus and is secured within the central opening 13 of the reel 12. The center drive device 28 includes a body portion 30 that is sized slightly larger than the central opening 13 such that the outer edge 40 of the body portion 30 frictionally secures the center drive device 28 to the inner edge 42 of the central opening 13 of the reel, such as by an interference or snap fit. In the embodiment shown in FIG. 3, the body portion 30 has a generally square configuration as does the central opening 13 of the reel. Thus, the center drive device 28 can be pressed into place within the central opening 13 in a plane parallel to the slot 14. The center drive device 28 can later be removed by pressing the center drive device with sufficient force to overcome the interference or frictional fit between the edges 40 of the body portion 30 and the edges 42 of the reel 12 defined by the central opening 13.

The center drive device 28 also includes at least one drive fitting 32 extending away from the body portion 30. In one embodiment, the drive fitting 32 is a hex nut having a six-sided polygonal configuration adapted for engaging a hex nut driver. Other shapes may also be used for the drive fitting. The drive fitting 32 is attached to the body portion 30 of the center drive device 28 at the central axis 15 via a bolt 36 extending through the body portion 30. Preferably, the present invention includes a second drive fitting 34 secured to the body portion 30 opposite the drive fitting 32 via the bolt 36 extending through the body portion such that the body portion is interposed between the drive fittings 32, 34.

Figure 5:
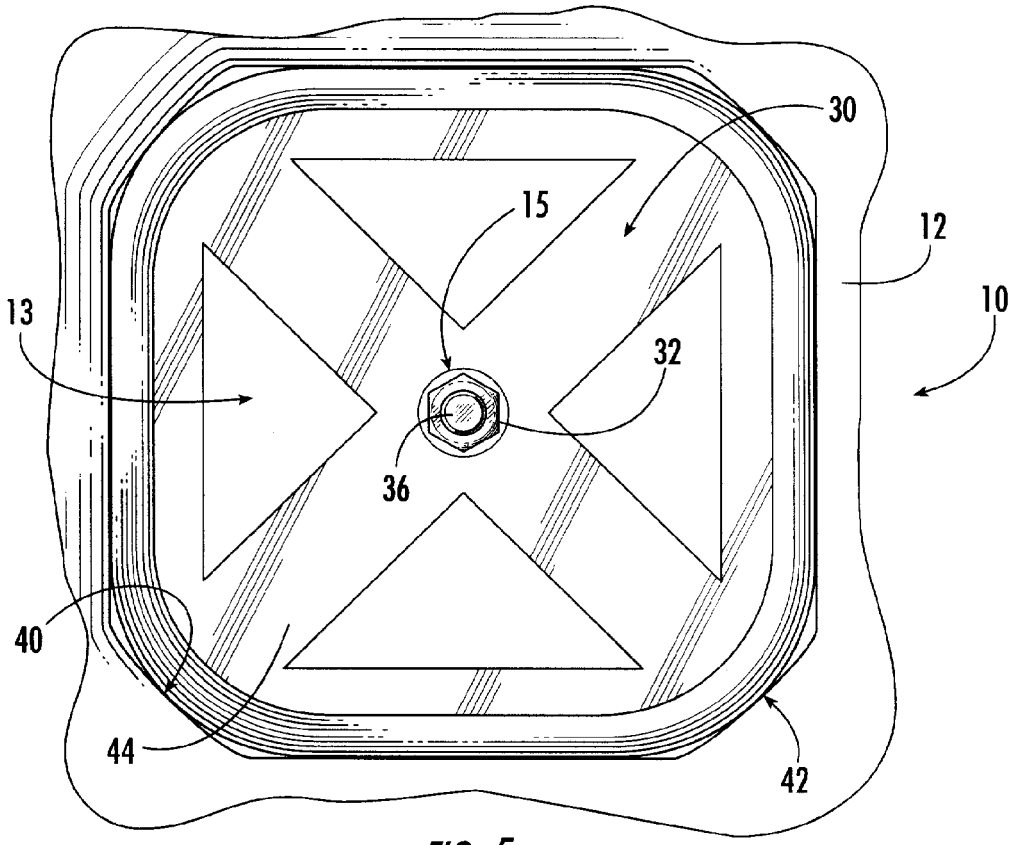
FIG. 5 is an elevation of another embodiment of the fish tape center drive device according to the present invention.

FIG. 5 shows an alternative embodiment of the center drive device 28 comprising a body portion 30 having a plurality of spokes 44 extending radially outward from a center part of the body portion on which the drive fittings 32, 34 are mounted. In this embodiment, the center drive device 28 has less weight, yet remains sufficiently rigid so that the center drive device does not inadvertently disengage from the reel 12.

Advantageously, the drive fittings 32, 34 of the center drive device 28 are provided for engagement with a powered driver, such as a hex nut driver or power drill 37. However, manual devices may also be used, such as a ratcheting socket driver. In one embodiment, the powered driver includes a nut driver 39 or the like having a shaft 38 gripped in the chuck for engaging one of the drive fittings 32, 34. The powered driver is operated such that the shaft, chuck, drive fittings 32, 34, and thus the center drive device 28 rotate. Because of the interference or frictional fit between the center drive device 28 and the reel 12, the center drive device rotates the reel about the central axis 15. The handle 16 is held stationary relative to the rotating reel 12, such that the handle slides along the slot 14. The rotation of the reel causes the fish tape 22 to be reeled in and wound about the hub 20, thereby simultaneously pulling a wire or other flexible elongate object through the conduit, thus saving valuable time to the operator.

Figure 6:
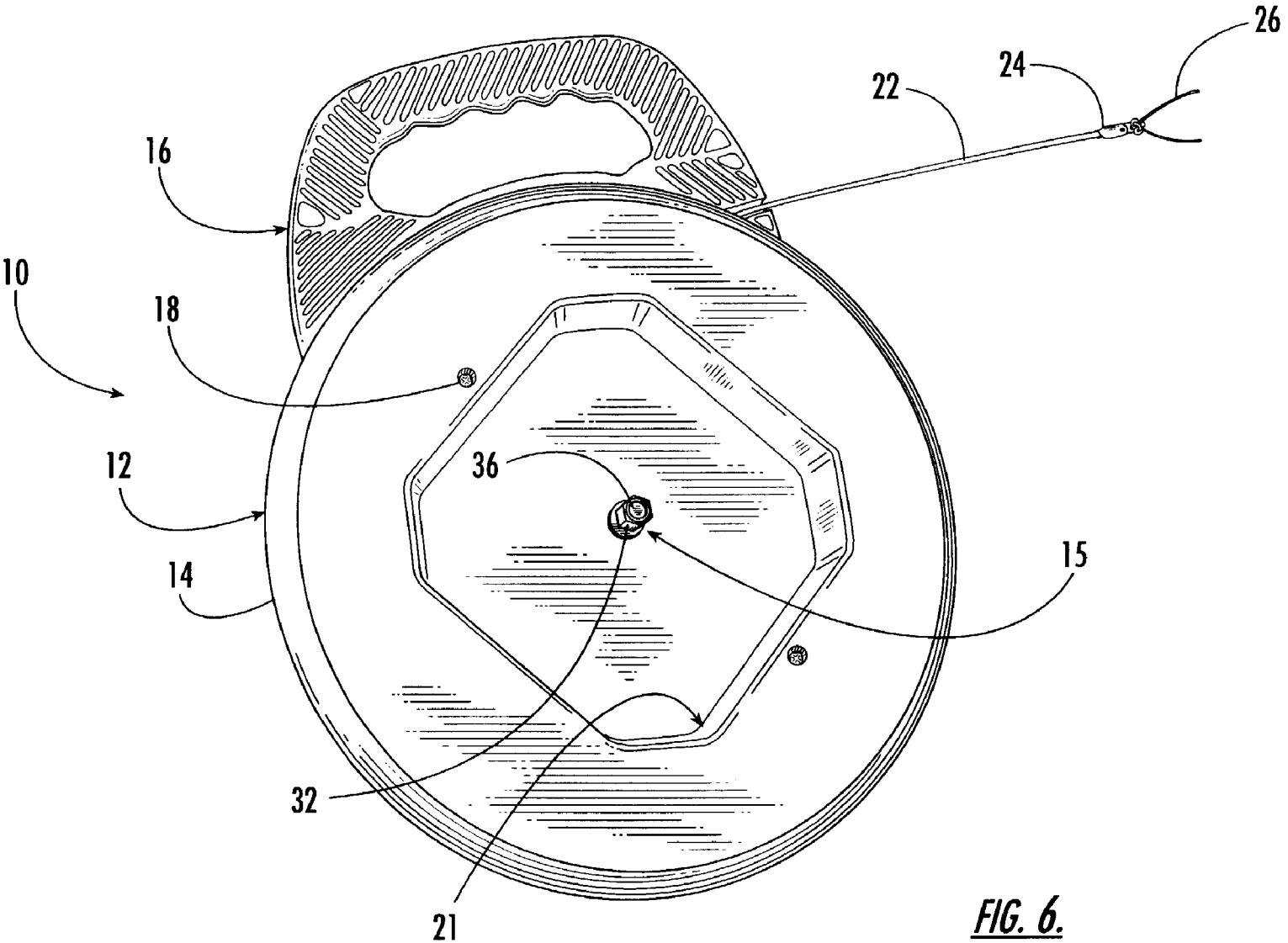
FIG. 6 is a perspective view of a fish tape apparatus according to another embodiment of the present invention.
Figure 7:
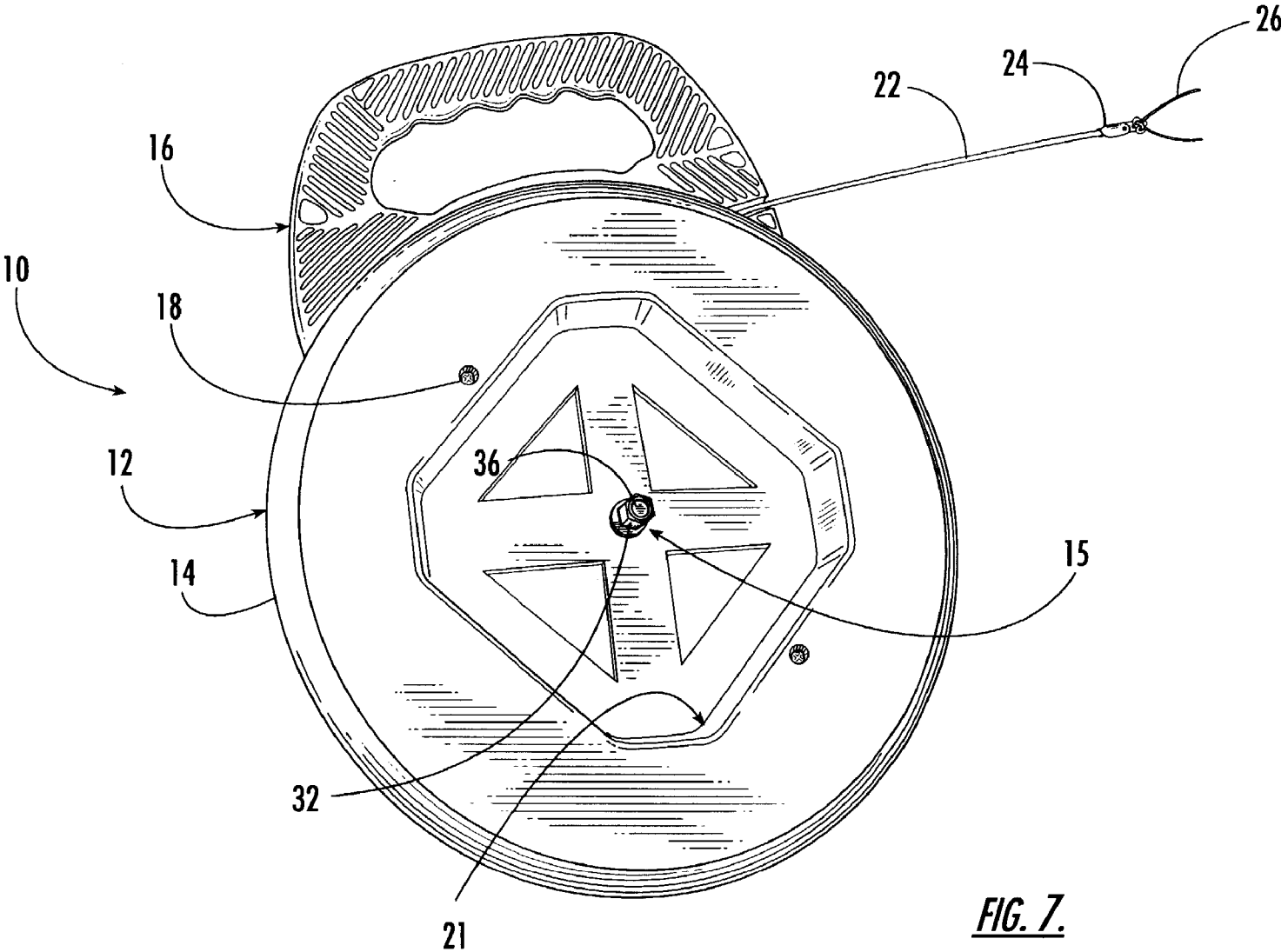
FIG. 7 is a perspective view of a fish tape apparatus according to yet another embodiment of the present invention.

FIGS. 6 and 7 show alternative embodiments of the present invention, wherein the center drive device 28 is formed integrally with the reel 12. For example, the body portion of the center drive device and one of the ring-shaped members 12*a* or 12*b* of the reel 12 can be formed as a one-piece construction, such as by injection-molding or the like. The center drive device 28 is positioned radially inward from the central hub 20 of the reel 12. As shown in FIGS. 6 and 7, the central hub 20 and center drive device 28 are formed such that a recessed portion 21 is defined therebetween. The recessed portion 21 provides a grippable surface for the operator's hand when a powered drive is not employed. In this regard, the spoked configuration of the center drive device (see FIG. 7) is particularly useful for providing a grippable surface between the spokes 44 for the operator's hand. The recessed portion 21, however, is not necessary to practice the invention, and thus can be eliminated if desired.

Thus, the present invention provides an efficient and easy-to-use fish tape device enabling automatic reeling of the fish tape via a center drive device of simple construction. The present invention also provides adaptability and interoperability with common powered drivers, as well as providing drive fittings on both sides of the reel so that the user can employ a powered driver using either hand. Furthermore, the present invention provides a fish tape apparatus having a center drive device that is less awkward to use than prior fish tape devices because the reel hangs down and is positioned below the handle, rather than being cantilevered forward from it.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A center drive device for attachment to a reeling apparatus having a ring-shaped reel and defining a central opening therein, said reeling apparatus also defining a slot extending about an outer periphery thereof and a sole handle slidably engaged such that the reel can be rotated while the handle remains stationary, said reeling apparatus adapted for reeling in a flexible tape onto the reel, said center drive device consisting essentially of:

a body portion configured to fit within the central opening to secure said center drive device to the reel; and a drive fitting attached to a first side of said body portion, said drive fitting positioned coaxially with the central opening of the reeling apparatus and configured to be engaged by a powered driver operable to rotatably drive the center drive device, whereby the reel is rotated for reeling in the flexible tape.

2. A center drive device according to claim 1, wherein the body portion has a solid shape.

3. A center drive device according to claim 1, wherein the body portion has a plurality of spokes with openings therebetween.

4. A center drive device according to claim 1, wherein the drive fitting has a polygon shape.

5. A center drive device according to claim 4, wherein the drive fitting extends away from said body portion.

6. A center drive device according to claim 4, wherein the drive fitting is a hex nut.

7. A fish tape apparatus for moving a flexible, elongate body through a conduit, the fish tape apparatus comprising:

a reel having a slot extending about an outer periphery thereof;

a sole handle slidably engaged in the slot such that the reel can be rotated about a central axis thereof while the fish tape apparatus is held by the handle, said reel having a central hub for supporting the flexible, elongate body wound thereon and defining a central opening coaxial with the central axis of said reel; and a center drive device mounted to the reel, said center drive device having a body portion fixed within the central opening of said reel and a drive fitting attached to a first side of said body portion, said drive fitting positioned coaxially with the central axis of the reel and configured to be engaged by a powered driver for rotating the reel about the central axis thereof.

8. A fish tape apparatus according to claim 7, further comprising a drive fitting attached to a second side of said body portion of said center drive device.

9. A fish tape apparatus according to claim 7, wherein said body portion of said center drive device has a solid shape.

10. A fish tape apparatus according to claim 7, wherein said body portion of said center drive device has a central hub and a plurality of spokes extending radially outward therefrom.

11. A fish tape apparatus according to claim 7, wherein the drive fitting has a polygonal shape.

12. A fish tape apparatus according to claim 11, wherein the drive fitting extends away from said body portion.

13. A fish tape apparatus according to claim 11, wherein the drive fitting is a hex nut.

14. A fish tape apparatus according to claim 7, wherein the center drive device is releasably attached to said reel.

15. A fish tape apparatus according to claim 7, wherein the center drive device is held by a snap fit within the central opening of said reel.

16. A fish tape apparatus for moving a flexible body through a conduit, the fish tape apparatus consisting essentially of:

a reel having a slot extending about an outer periphery thereof; and a single handle slidably engaged in the slot such that the reel can be rotated about a central axis thereof while the fish tape apparatus is held by the handle, said reel having a hub for supporting the flexible body wound thereon and having a center drive device positioned radially inward from said hub and formed integrally therewith, said center drive device having a body portion and a drive fitting attached to a first side of said body portion, said drive fitting positioned coaxially with the central axis of the reel and configured to be engaged by a driver for rotating the reel about the central axis thereof.

17. A fish tape apparatus according to claim 16, wherein said body portion of said center drive device has a solid shape.

18. A fish tape apparatus according to claim 16, wherein said body portion of said center drive device has a plurality of spokes.

19. A fish tape apparatus according to claim 16, wherein the drive fitting has a polygonal shape.

20. A fish tape apparatus according to claim 16, wherein the drive fitting extends away from said body portion.

21. In a fish tape apparatus for moving a flexible, elongate body through a conduit having a reel defining a central axis and a slot extending about an outer periphery thereof, the reel including a central hub for supporting the flexible, elongate body wound thereon and defining a central opening that is coaxial with the central axis, and a single handle slidably engaged in the slot such that the reel can be rotated about the central axis thereof while the handle is held by an operator, the improvement consisting essentially of a center drive device having a body portion fixed within the central opening of the reel and a drive fitting attached to a first side of the body portion, the drive fitting positioned coaxially with the central axis of the reel and configured to be engaged by a powered driver for rotating the reel about the central axis while the handle that is slidably engaged in the outer periphery slot of the reel is held by an operator.

22. A center drive device for attachment to a reeling apparatus having a ring-shaped reel and defining a central opening therein, said reeling apparatus also defining a slot extending about an outer periphery thereof and a sole handle slidably engaged such that the reel can be rotated while the handle remains stationary, said reeling apparatus adapted for reeling in a flexible tape onto the reel, said center drive device consisting essentially of;

a body portion configured to fit within the central opening to secure said center drive device to the reel;

a drive fitting attached to a first side of said body portion, said drive fitting positioned coaxially with the central opening of the reeling apparatus and configured to be engaged by a powered driver operable to rotatably drive the center drive device, whereby the reel is rotated for reeling in the flexible tape; and a drive fitting attached to a second side of said body portion.

23. A fish tape apparatus for moving a flexible body through a conduit, the fish tape apparatus consisting essentially of:

a reel having a slot extending about an outer periphery thereof;

a single handle slidably engaged in the slot such that the reel can be rotated about a central axis thereof while the fish tape apparatus is held by the handle, said reel having a hub for supporting the flexible body wound thereon and having a center drive device positioned radially inward from said hub and formed integrally therewith, said center drive device having a body portion and a drive fitting attached to a fist side of said body portion, said drive fitting positioned coaxially with the central axis of the reel and configured to be engaged by a driver for rotating the reel about the central axis hereof; and a drive fitting attached to a second side of said body portion of said center drive device.

* * * * *

UNITED STATES PATENT AND TRADEMARK OFFICE

CERTIFICATE OF CORRECTION

PATENT NO. : 6,513,791 B1
DATED : February 4, 2003
INVENTOR(S) : Yates

It is certified that error appears in the above-identified patent and that said Letters Patent is hereby corrected as shown below:

Column 8,
Line 3, the semicolon (;) should be a colon (:);
Line 28, "fist" should read -- first --;
Line 32, "hereof" should read -- thereof --.

Signed and Sealed this

Eighth Day of July, 2003

JAMES E. ROGAN
*Director of the United States Patent and Trademark Office*